US010591130B2

(12) United States Patent
Courcier et al.

(10) Patent No.: US 10,591,130 B2
(45) Date of Patent: Mar. 17, 2020

(54) LIGHT-BEAM-PROJECTING DEVICE COMPRISING A DIGITAL SCREEN AND HEADLAMP EQUIPPED WITH SUCH A DEVICE

(71) Applicant: VALEO VISION, Bobigny (FR)

(72) Inventors: Marine Courcier, Bobigny (FR); Pierre Albou, Bobigny (FR)

(73) Assignee: VALEO VISION, Bobigny (FR)

( * ) Notice: Subject to any disclaimer, the term of this patent is extended or adjusted under 35 U.S.C. 154(b) by 29 days.

(21) Appl. No.: 15/760,049

(22) PCT Filed: Sep. 14, 2016

(86) PCT No.: PCT/EP2016/071681

§ 371 (c)(1),
(2) Date: Mar. 14, 2018

(87) PCT Pub. No.: WO2017/046157

PCT Pub. Date: Mar. 23, 2017

(65) Prior Publication Data

US 2018/0259148 A1 Sep. 13, 2018

(30) Foreign Application Priority Data

Sep. 15, 2015 (FR) ..... 15 58605

(51) Int. Cl.
*F21S 41/675* (2018.01)
*F21S 41/32* (2018.01)
(Continued)

(52) U.S. Cl.
CPC ..... *F21S 41/675* (2018.01); *F21S 41/14* (2018.01); *F21S 41/16* (2018.01); *F21S 41/25* (2018.01);
(Continued)

(58) Field of Classification Search
CPC ..... F21S 41/675; F21S 41/25; F21S 41/16; F21S 41/14; F21S 41/265; F21S 41/32; F21S 41/147
See application file for complete search history.

(56) References Cited

U.S. PATENT DOCUMENTS

2003/0107323 A1 6/2003 Stam
2004/0160758 A1* 8/2004 Chang ..... G02B 26/0833 362/602

(Continued)

FOREIGN PATENT DOCUMENTS

DE 10 2011 052 184 A1 5/2012
EP 1 433 655 A2 6/2004

(Continued)

OTHER PUBLICATIONS

International Search Report dated Dec. 8, 2016 in PCT/EP2016/071681 filed Sep. 14, 2016.

*Primary Examiner* — Anh T Mai
*Assistant Examiner* — Glenn D Zimmerman
(74) *Attorney, Agent, or Firm* — Oblon, McClelland, Maier & Neustadt, L.L.P.

(57) ABSTRACT

An automotive vehicle light beam projection device, including at least one light source able to emit light rays, an optical projection system with an exit pupil situated on an optical exit element, which optical system is able to project a light beam, wherein the light beam includes a digital screen configured to direct at least one part of the incident light rays emitted by at least one source toward the optical projection system, the device furthermore including means for focusing the light rays emitted by the at least one light source on a zone of the digital screen, and an intermediate assembly for projecting the light rays originating from the digital screen which are configured to illuminate the surface area of the exit pupil.

21 Claims, 2 Drawing Sheets

Figure 1:
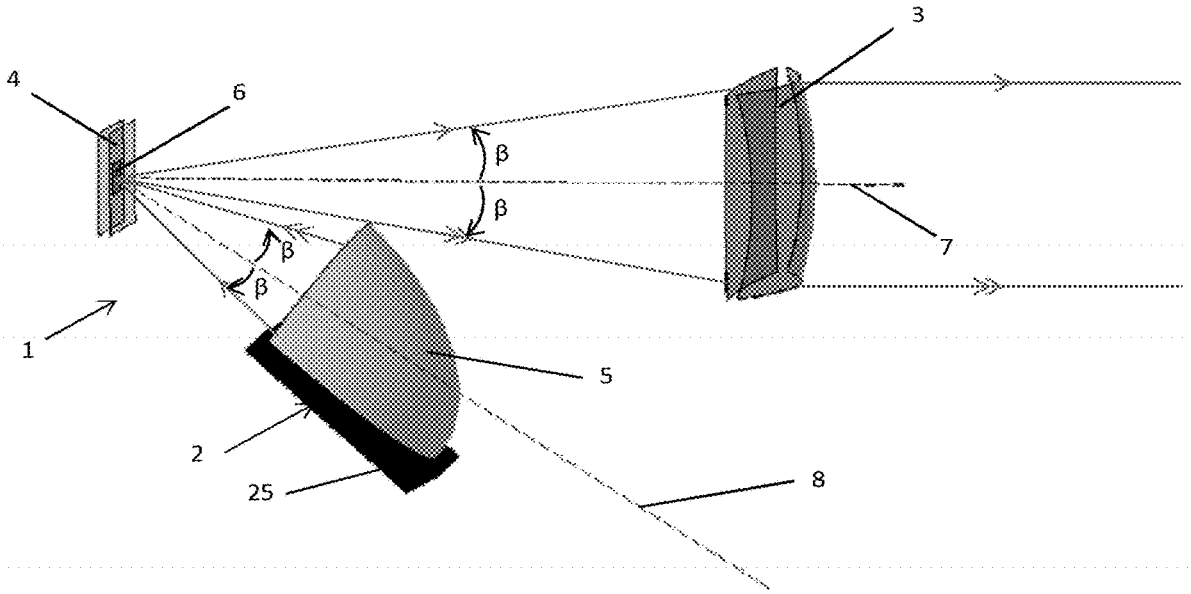

(51) Int. Cl.

| | |
|---|---|
| ***F21S 41/16*** | (2018.01) |
| ***F21S 41/14*** | (2018.01) |
| ***F21S 41/265*** | (2018.01) |
| ***F21S 41/25*** | (2018.01) |
| *F21S 41/147* | (2018.01) |

(52) U.S. Cl.
CPC ..... *F21S 41/265* (2018.01); *F21S 41/32* (2018.01); *F21S 41/147* (2018.01)

(56) References Cited

U.S. PATENT DOCUMENTS

| | | | | |
|---|---|---|---|---|
| 2004/0218401 | A1 | 11/2004 | Okubo et al. | |
| 2005/0073853 | A1 | 4/2005 | Stam | |
| 2010/0208478 | A1 | 8/2010 | Fang et al. | |
| 2012/0127747 | A1 | 5/2012 | Ahn et al. | |
| 2014/0313760 | A1 | 10/2014 | Yagi | |
| 2016/0109069 | A1* | 4/2016 | Avina Silva | F21V 19/045 362/218 |
| 2016/0347237 | A1* | 12/2016 | Bhakta | F21S 41/285 |
| 2019/0056081 | A1* | 2/2019 | Bhakta | G02B 26/0833 |

FOREIGN PATENT DOCUMENTS

| | | | | |
|---|---|---|---|---|
| EP | 2 463 150 | A1 | 6/2012 | |
| EP | 2 796 773 | A2 | 10/2014 | |
| JP | 2010-218964 | A | 9/2010 | |
| WO | WO-2014073945 | A1 * | 5/2014 | F21V 19/045 |
| WO | 2015/122481 | A1 | 8/2015 | |

* cited by examiner

LIGHT-BEAM-PROJECTING DEVICE COMPRISING A DIGITAL SCREEN AND HEADLAMP EQUIPPED WITH SUCH A DEVICE

The present invention relates to a light beam projection device with digital screen, in particular for an automotive vehicle, and an automobile lighting light beam headlamp, of low-beam headlight or high-beam headlight type, furnished with such a projection device.

Automotive vehicle headlamps are furnished with several elements arranged in a housing in such a way as to obtain a light beam at the exit of the headlamp. In a simplified manner, the elements of the housing comprise in particular a light source, for example a (or several) light-emitting diode(s), which emits light rays, and projection means able to form a light beam on the basis of the light rays issuing from the light source and which are made up for example of the association of a reflector disposed in proximity to the light source and a lens at the exit of the headlamp. The function of the reflector is to concentrate and to orient the light rays issuing from the light source so as to direct them toward the lens, which finishes forming the light beam for the headlamp. The projection means may alternatively comprise only reflectors or only lenses.

It is known that certain automotive vehicle headlamps are capable of varying the orientation of the light beam and/or its shape as a function of the vehicle driver's needs. A first function thus carried out is the dynamic bending lighting function, also known by the acronym DBL, standing for Dynamic Bending Light. When the vehicle takes a bend, an electronic system on board the vehicle commands a modification of the orientation of the light beam so as to adapt it to the driver's fields of vision during the maneuver. The headlamp thus displaces the axis of the light beam in the direction of rotation of the vehicle so as to better illuminate the road.

To this end, headlamps use mechanical means which displace certain elements of the headlamp, or the entire headlamp, in order to modify the direction of the light beam.

However, these mechanical means are complex and expensive to manufacture. Moreover, they demand fairly significant energy consumption in order to be actuated.

A second function relates to the possibility of producing adaptive lighting beams (known by the acronym ADB, standing for Adaptive Driving Beam), as a function of the traffic flow conditions and in particular to produce dark tunnels in order to isolate in the projected beam overtaken or followed vehicles, so as not to dazzle them (anti-dazzle high-beam headlight function, also known by the acronym GFHB standing for Glare-Free High Beam).

The achieving of this function by means of rotary modules such as described previously which are associated with a set of diaphragms so as to create a dark zone in the beam and illuminate either side of the vehicle located in said dark zone is thus known from WO2008/037388.

Other techniques for achieving this adaptive lighting function are also known, in particular using projection systems producing beams with vertical bands or with an array of pixels. In particular, it is known to associate arrays of light-emitting diodes with light guides coupled to projection means or else to resort to a laser beam scanning system or to use a digital screen such as an array of micro-mirrors (also known by the acronym DMD, standing for Digital Micromirror Device).

An automobile headlamp solution based on an array of micro-mirrors on which a xenon light source is collimated is in particular described in document WO99/11968.

This micro-mirror array technology is particularly beneficial today since it is technically mature and exhibits a relatively affordable cost for usage in automobile lighting, and makes it possible to develop a compact and precise lighting system, with a high number of pixels.

However, the known headlamps associating a xenon light source and a micro-mirror array are not particularly optimized, comprising a collimation of the source on the micro-mirror array which exhibits significant bulkiness and complex projection optics with more than four lenses, or indeed more than six lenses.

The invention is therefore aimed firstly at obtaining a headlamp configured to project a light beam which can be modified as a function of the trajectory of the vehicle or of the driving circumstances (adaptive beam), and which does not use any exacting mechanical means or ones with a significant travel to perform these modifications.

Furthermore, the invention is aimed at making it possible to produce in a simple manner an efficacious headlamp (with good efficiency) using a digital screen of micro-mirror array type, while utilizing the light sources effectively.

Accordingly, the invention relates to a light beam projection device, in particular for an automotive vehicle, comprising at least one light source able to emit light rays, an optical projection system with an exit pupil situated on an optical exit element, which projection system is able to project a light beam.

The projection device is noteworthy in that it comprises a digital screen configured to direct at least one part of the incident light rays emitted by the source toward said optical projection system, the device furthermore comprising means for focusing the light rays emitted by the at least one light source on a zone of the digital screen, and an intermediate assembly for projecting the light rays originating from the digital screen which are configured to illuminate the surface of said exit pupil.

Thus, a digital screen is used to modulate the light beam projected by the device. To achieve this, the focusing means concentrate the light rays emitted by the source on a zone of the digital screen, which acts as a mirror so as to direct them toward the optical projection system. The digital screen makes it possible to control the apparent dimensions and orientation as well as the structure of the light beam by activating or deactivating pixels corresponding to a subdivision of its surface into elements that are liable to send the light which reaches them out of the optical projection system comprising an optical exit element, thus extinguishing a zone of the beam.

The invention makes it possible on the one hand to dispense with mechanical means having a large travel, and on the other hand to use a digital screen effectively by virtue of the means for focusing the light rays on a zone of the digital screen and by virtue of the intermediate projection assembly which produces an anamorphosis of the surface of the digital screen on the exit pupil of the optical projection system.

According to various embodiments of the invention, which may be taken together or separately:

- the focusing means comprise a reflector, the light source being disposed at a first optical focus of said reflector and the digital screen being disposed at a second optical focus of said reflector, the intermediate projection assembly is configured to project the light rays originating from the digital screen so as to illuminate substantially the whole surface area of the exit pupil, the intermediate projection assembly forms with the optical exit element a bifocal system, the intermediate projection assembly comprises at least one lens and at most three lenses, preferably two lenses, the focusing means are configured to form a widened image of the rays of the light source on the digital screen, the device comprises several light sources, the focusing means comprising a reflector or a reflector cavity associated with each light source or set of sources, the digital screen is an array of micro-mirrors, the orientation of each of the micro-mirrors being able to take two positions, a first position in which the light rays are reflected toward the optical projection system and a second position in which the light rays are reflected in a different direction from the optical projection system, the micro-mirror array is arranged so that the semi-aperture angle $\beta$ of the light rays of the light source on the digital screen and the semi-aperture angle $\beta$ of the light rays toward the projection system with respect to the screen are less than $2\alpha$, $\alpha$ being the characteristic angle of orientation of the micro-mirrors of the array of micro-mirrors, the light source comprises at least one light-emitting diode, the light source comprises at least one laser source or a laser diode, the exit pupil of the optical system exhibits, in projection on a plane perpendicular to the projection axis, a substantially rectangular shape with a ratio of at least 3, preferentially at least 4 or 5 between the dimensions of the small side and of the large side, the optical exit element is of elongate shape and has a dimension perpendicular to the optical axis which is less than 50 mm, preferentially less than 30 mm, more preferentially less than 20 mm, the optical exit element is a lens, the optical exit element is a reflector, the light beam generated by the device is a high beam.

The invention also pertains to an automotive vehicle headlamp comprising such a projection device.

Figure 2:
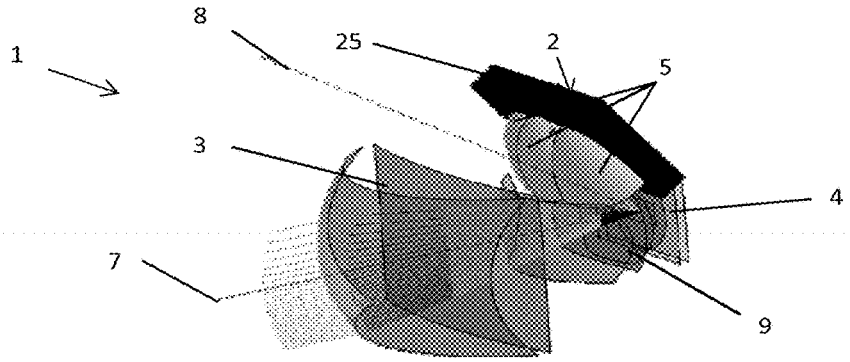
Figure 3:
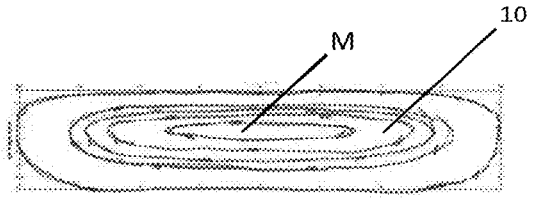
Figure 4:
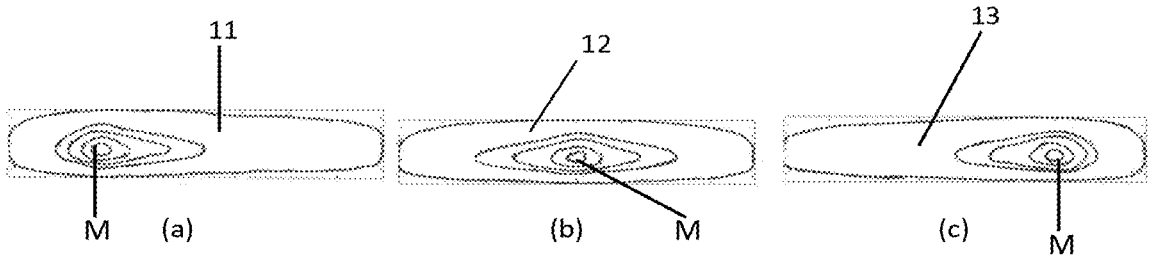
Figure 5:
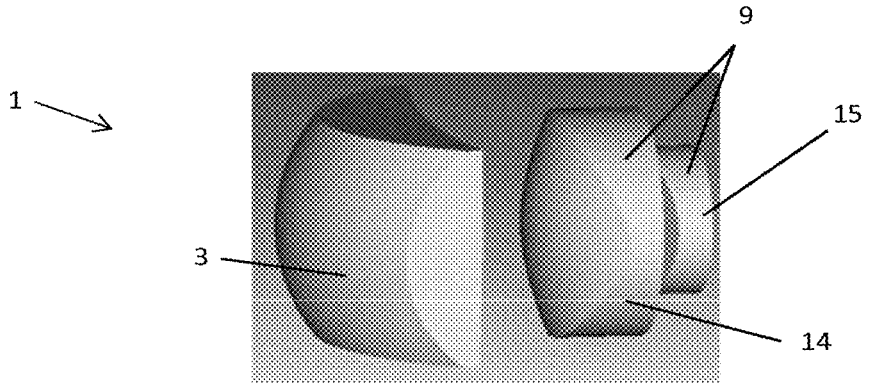
Figure 6:
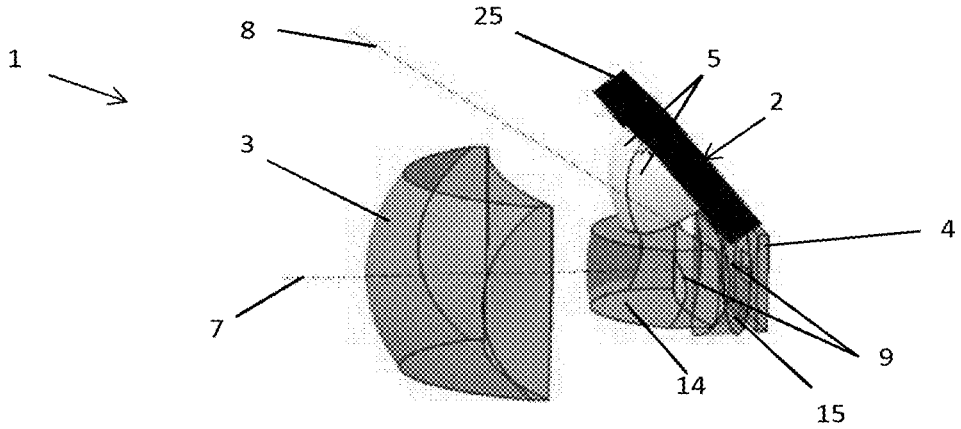

The invention will be better understood in the light of the following description which is given solely by way of indication and the aim of which is not to limit it, accompanied by the attached drawings:

FIG. 1 illustrating in a schematic manner a first part of the light beam projection device with digital screen according to the invention, in a profile view;

FIG. 2 illustrating in a schematic manner a perspective view of a light beam projection device with digital screen according to one embodiment of the invention, FIG. 3 illustrating the shape of the beam incident on the digital screen originating from the light source or sources, FIGS. 4 (*a*), (*b*) and (*c*) illustrating examples of shapes of the beam reflected by the digital screen toward the lens-forming means, on the basis of the incident beam illustrated in FIG. 3, FIG. 5 illustrating in a schematic manner a second part of the projection device according to the invention, FIG. 6 illustrating in a schematic manner a profile view of a light beam projection device with digital screen according to one embodiment of the invention.

For reasons of ease of representation, FIG. 1 partially illustrates the device according to the invention, the intermediate projection assembly not being represented therein. The latter is visible in FIGS. 2, 5 and 6.

The light beam projection device 1 comprises at least one light source 2 able to emit light rays. The embodiment represented in FIG. 1 has a single light source 2, and the embodiments represented in FIGS. 2 and 6 have three light sources 2 disposed side by side. The light source or sources 2 are arranged on a support 25.

In a first embodiment, the light source or sources 2 are formed of at least one light-emitting diode (LED) disposed on the support 25. Advantageously, this entails a set of light sources, which set is of the multichip light-emitting diode type, that is to say entails a single electronic component comprising several electroluminescent emitters.

In a second embodiment, the light source 2 associates a laser source with at least one light-emitting diode. The laser source is directed toward the diode disposed on the support. The diode also comprises a wavelength conversion upper layer, for example of phosphor, to scatter a part of the light of the laser and convert another part into an appropriate color. The laser source transmits to the conversion element additional light which supplements the quantity of light coming from the diode without modifying the dimensions or the characteristics of the light source.

In a third embodiment, the light source 2 comprises only one or more laser sources or laser diodes. The laser source 2 is either disposed on the support 25 or remote from the support 25 and directed toward the latter. In the first variant, the laser source is disposed in the place of the light-emitting diode. In the second variant, the support 25 is furnished with a radiation wavelength conversion element for converting the light rays into the desired color. It is for example possible to use a plate made of luminophore material as support 25. The luminophore material plate can be used in transmission or in reflection. In transmission, the laser passes through the plate, and in reflection the laser is reflected by the plate. The laser diode and the plate are therefore disposed at a location corresponding to this type of use, that is to say above or below.

In a last embodiment, the light source is a combination of light-emitting diodes and of laser diodes. In particular, the diode or diodes illuminating more specifically the central part of the digital screen 4 are one or more laser diodes and the diodes illuminating the periphery of the digital screen are light-emitting diodes.

The use of light sources of the semiconductor opto-electronic component type, such as light-emitting diodes or laser diodes, is particularly advantageous with respect to a xenon source: not only do they not emit any infrared radiation liable to heat the digital screen and to cause a malfunction of the latter, but in addition they emit in a Lambertian half-space (whilst the xenon source emits in all directions) and therefore generate much less significant bulkiness of the focusing means for directing the luminous flux emitted by these sources on the digital screen.

In FIGS. 1, 2, 5 and 6, the light beam projection device 1 comprises an optical projection system comprising an optical exit element, which here is an exit lens 3. This optical projection system is able to project a light beam, at the exit of a projection module or of a headlamp for example. Thus, the light rays emitted by the light source or sources 2 are deviated to form a beam corresponding to a beam of low-beam headlight or high-beam headlight type or any other desired beam. The optical projection system projects the beam around an optical projection axis 7.

The device 1 furthermore comprises means 5 for focusing the light rays emitted by the light source 2 on the digital screen 4 around an optical illumination axis 8. Recourse to focusing means instead of means for collimating the light emitted by the light source or sources on the digital screen 4 advantageously makes it possible to generate a variable (non-uniform) luminous intensity distribution on said digital screen 4, with a zone of maximum intensity M in the beam. The effectiveness of the device is thus greatly improved with the aim of producing an automobile lighting beam.

According to the invention, the projection device 1 furthermore comprises a digital screen 4 configured to direct toward the projection system at least one part of the incident light rays emitted by the source 2. The digital screen 4 is formed of individually controlled pixels. Each pixel is configured to either allow the incident light rays to reach the optical projection system or prevent them from reaching the optical projection system. Thus, by virtue of the digital screen 4, it is possible to choose the shape and the orientation of the beam projected by the device 1 by activating or by deactivating the pixels which make up the digital screen 4.

FIG. 3 represents an exemplary shape of the incident beam 10 on the digital screen 4 issuing from the light source or sources 2, and FIGS. 4 (*a*), (*b*) and (*c*) show three beam shape examples returned 11, 12, 13 by the digital screen on the basis of the incident beam 10 of FIG. 3. The incident light beam 10 has a widened shape in the horizontal plane corresponding to the plane in which it is desired to carry out a modification of orientation of the beam projected on the road, with a zone of maximum intensity M. The digital screen 4 makes it possible to select a part of the incident beam by activating some of the pixels. The beam returned by the digital screen 4 consequently has a different orientation depending on the selection made, as shown by the examples of FIGS. 4(*a*), 4(*b*) and 4(*c*). In FIG. 4(*a*), the reflected beam 11 is oriented toward the left, the beam 12 of FIG. 4(*b*) is centered and corresponds by default to a high beam and the beam 13 of FIG. 4(*c*) is oriented toward the right, the position of the zone of maximum intensity M varying according to the orientation. In an automobile headlamp, it is therefore possible to choose the orientation of the beam projected on the road and adapt it to a situation, for example on a bend.

In the embodiments represented in FIGS. 1, 2 and 6, the digital screen 4 is an array of micro-mirrors (also known by the acronym DMD, standing for Digital Micromirror Device) which directs the light rays by reflection. The light rays are reflected in two possible directions: either toward the optical projection system and the exit lens 3 around the optical projection axis 7, to form the beam projected by the projection device 1, or in a different direction from the optical projection system and the exit lens 3.

To this end, each micro-mirror can pivot between two fixed positions, a first position in which the light rays are reflected toward the optical projection system, and the exit lens 3, and a second position in which the light rays are reflected in a different direction from the optical projection system, and the exit lens 3. The two fixed positions are oriented in the same manner for all the micro-mirrors and form with respect to a support reference plane of the micro-mirror array an angle $\alpha$ which is characteristic of the array of micro-mirrors and which is defined in its specifications. This angle $\alpha$ is generally less than 20° and usually equals about 12°.

Thus, each micro-mirror reflecting a small part of the light rays incident on the array, the actuation of the change of position makes it possible to modify the shape of the beam emitted by the optical projection system and ultimately the exit lens 3. The light rays returned by the micro-mirrors toward the optical projection system participate in the beam projected by the projection device 1. And the light rays returned by the micro-mirrors in a different direction do not participate in the projected beam. On the basis of the incident beam 10 of FIG. 3, it is possible to select just a part of the beam so as to reflect it toward the optical projection system, said part corresponding for example to one of those of FIG. 4.

As represented in FIG. 1, the array of micro-mirrors and the light source or sources 2 are arranged so that the semi-aperture angle $\beta$ of the light rays incident on the digital screen 4 is at most equal to twice the characteristic angle $\alpha$ of the micro-mirrors of the digital screen 4. Thus, the semi-aperture angle $\beta$ of the light rays reflected toward the optical projection system is also less than twice the characteristic angle $\alpha$ of the digital screen 4 when the micro-mirrors are in the first position. The aperture angle of the incident light rays is defined with respect to the optical illumination axis 8, and the aperture angle of the reflected light rays is defined with respect to the optical projection axis 7.

The optical illumination axis 8 and the optical projection axis 7 form an angle of greater than or equal to $2\alpha$ between them. Thus, when the micro-mirrors are in the first position, substantially all the light rays are returned toward the optical projection system, and when the micro-mirrors are in the second position, substantially all the light rays are returned in a different direction from the optical projection system. This therefore avoids light rays being directed toward the optical projection system whilst they are reflected by a micro-mirror disposed in the second position. Indeed, with an angle of less than $2\alpha$ between the two optical axes, certain light rays would nevertheless be reflected toward the optical projection system and ultimately the exit lens 3 whilst the micro-mirrors are in the second position.

Furthermore, the focusing means 5 focus the light rays on a zone 6 of the digital screen 4. The light rays are concentrated on a reduced zone 6 of the digital screen 4 so as to guarantee a sufficiently powerful beam emitted by the device 1 while remaining compact. By virtue of the projection device 1 according to the invention, it is possible to use a digital screen in association with projection means to form a beam of low-beam headlight or high-beam headlight type with dynamic bending or anti-dazzle functions.

Advantageously, the focusing means 5 are configured to form a widened image on the digital screen 4. Thus, it is easy to select a part of the incident rays and to deviate the light beam as desired. For example, if the light source is a single LED, the magnification will be by a factor of 3 to 5, while if the light source is composed of a plurality of juxtaposed LEDs or of a multichip LED, the magnification will lie between a factor of 1.1 and 2.

In FIGS. 1, 2 and 6, the focusing means are a substantially elliptical reflector, the light source 2 being disposed at a first optical focus of said reflector and the digital screen 4 being disposed at a second optical focus of said reflector. When there is only one reflector for the light source, it is dimensioned to obtain a widened shape of the beam like that of FIG. 3.

In a variant embodiment not represented, with a single reflector and several light sources, each light source or set of sources is disposed so as to illuminate a substantially distinct zone of the digital screen.

In a variant embodiment represented in FIGS. 2 and 6, the device 1 comprises several light sources or a set of light sources 2, the first focusing means comprising an elliptical reflector or a reflector cavity associated with each light source 2, each light source 2 and reflector or reflector cavity set being configured to illuminate a substantially distinct zone of the digital screen 4.

According to a particularly advantageous and preferred characteristic, the optical projection system consists of a single optical exit element.

According to an essential characteristic of the invention, the device 1 is furnished with an intermediate assembly 9 for projecting the light rays reflected by the digital screen 4 toward the optical projection system, and in particular the optical exit element, here consisting of an exit lens 3, such as represented in FIGS. 2, 5 and 6. The intermediate projection assembly 9 is advantageously configured to project the light rays originating from the digital screen 4 so as to illuminate substantially the whole surface area of the exit pupil of the optical projection system, this exit pupil being situated on the optical exit element. Thus, the device remains compact since it is possible to have a projection system comprising an optical exit element, in particular an exit lens 3, sufficiently close to the digital screen 4 without losing light, the intermediate projection assembly 9 having the function of adapting the orientation of the rays reflected by the screen 4 to the dimensions of the optical exit element, and in particular of the optical system's exit pupil carried by said optical exit element.

This intermediate projection assembly comprises at least one lens and at most three lenses. Preferably, it comprises two lenses.

With reference to FIGS. 5 and 6, the intermediate projection assembly comprises a first lens 15 and a second lens 14. Preferably, the first lens 15 is convergent at least in a plane. These lenses of the intermediate assembly 9 can be cylindrical or toroidal. For bulkiness reasons, and so as to make it possible in particular to position the focusing means 5 as near as possible, the second lens 14 can be cut transversely. Preferably, the first lens 15 is positioned in proximity to the digital screen 4, at a distance of less than 10 mm, while the second lens 14 is close to the exit lens 3, also at a distance of less than 10 mm.

The two lenses 14,15 of the intermediate assembly 9 are configured to spread the light rays substantially over the whole width and the whole height of the exit pupil, so that the exit face of the optical exit element, here the exit lens 3, appears entirely or almost entirely illuminated for an observer placed on the optical axis and looking at said exit face. Here, substantially is understood to mean 100% of the dimension, +−5%. Thus, the shape of the light rays returned by the digital screen 4 is adapted to the dimensions of the optical exit element, here the exit lens 3, so as to preserve a compact device. At the same time, optimized luminous effectiveness of the device is also ensured.

According to an advantageous characteristic of the invention, the intermediate projection assembly 9 and the optical exit element form a bifocal system, that is to say with a first focal length in a first plane containing the optical projection axis 7 and a second focal length in a second plane containing the optical projection axis and perpendicular to the first plane.

Indeed, for reasons of style, the optical exit element very often exhibits an elongate shape in a direction perpendicular to the optical axis. In the smallest dimension of the optical exit element, for example its height, the largest focal length of the system is calculated so as to correspond to the aperture angle $2\alpha$ of the micro-mirror array. In the other dimension perpendicular to the first, for example the length, a small focal length will be chosen so as to spread the beam in the corresponding direction, for example to produce a beam of high-beam type open to 20° horizontally on either side of the optical axis. According to the example described, the exit lens 3 is elongate along a substantially horizontal axis, but it will be entirely possible to adapt the device to a substantially vertical orientation of the length of the optical exit element without departing from the scope of the present invention.

It is then understood that, by virtue of this bifocal system, it is possible to use in an effective manner the micro-mirror arrays available today, which are in dimensions of the video type, with a width to height area ratio of for example 4/3, 16/9 or 16/10, and to make it compatible with the dimensional constraints of the lighting beams and of the style of the optical exit elements, without losing light.

Furthermore, this bifocal system is simple, comprising a limited number of optical elements, preferentially fewer than four optical elements, including the optical exit element.

The invention claimed is:

1. An automotive vehicle light beam projection device, comprising:

at least one light source configured to emit light rays, an optical projection system with an exit pupil situated on an optical exit element, the optical projection system configured to project a light beam, a digital screen configured to direct at least one part of the incident light rays emitted by the at least one light source toward said optical projection system, means for focusing the light rays emitted by the at least one light source directly on a zone of the digital screen, and an intermediate assembly for projecting the light rays originating from the digital screen which are configured to illuminate the surface area of the exit pupil.

2. The device as claimed in claim 1, wherein the means for focusing comprise a reflector, the light source being disposed at a first optical focus of said reflector and the digital screen being disposed at a second optical focus of said reflector.

3. The device as claimed in claim 1, wherein the intermediate projection assembly is configured to project the light rays originating from the digital screen so as to illuminate substantially the whole surface area of the exit pupil.

4. The device as claimed in claim 1, wherein the optical exit element is an exit lens.

5. The device as claimed in claim 1, wherein the optical exit element is a reflector.

6. The device as claimed in claim 1, wherein the means for focusing are configured to form a widened image of the rays of the light source on the digital screen.

7. The device as claimed in claim 1, wherein the device comprises several light sources, the means for focusing comprising a reflector or a reflector cavity associated with each light source or set of sources.

8. The device as claimed in claim 1, wherein the digital screen is an array of micro-mirrors, the orientation of each of the micro-mirrors being adjustable to take two positions, a first position wherein the light rays are reflected toward the optical projection system, and a second position wherein the light rays are reflected in a different direction from the optical projection system.

9. The device as claimed in claim 1, wherein the light source comprises at least one light-emitting diode.

10. The device as claimed in claim 1, wherein the light source comprises at least one laser source or a laser diode.

11. The device as claimed in claim 1, wherein the light beam is a lighting beam.

12. An automotive vehicle headlamp comprising a light beam projection device as claimed in claim 1.

13. The device as claimed in claim 1, wherein the incident light rays from the means for focusing reach the digital screen without reflection.

14. The device as claimed in claim 2, wherein the intermediate projection assembly is configured to project the light rays originating from the digital screen so as to illuminate substantially the whole surface area of the exit pupil.

15. The device as claimed in claim 2, wherein the optical exit element is an exit lens.

16. The device as claimed in claim 2, wherein the optical exit element is a reflector.

17. The device as claimed in claim 2, wherein the means for focusing are configured to form a widened image of the rays of the light source on the digital screen.

18. The device as claimed in claim 2, wherein the device comprises several light sources, the means for focusing comprising a reflector or a reflector cavity associated with each light source or set of sources.

19. The device as claimed in claim 2, wherein the digital screen is an array of micro-mirrors, the orientation of each of the micro-mirrors being adjustable to take two positions, a first position wherein the light rays are reflected toward the optical projection system, and a second position wherein the light rays are reflected in a different direction from the optical projection system.

20. The device as claimed in claim 3, wherein the intermediate projection assembly and the optical exit element form a bifocal system.

21. The device as claimed in claim 8, wherein the micro-mirror array is arranged so that the semi-aperture angle $\beta$ of the light rays of the light source on the digital screen and the semi-aperture angle $\beta$ of the light rays toward the optical projection system with respect to the screen are less than $2\alpha$, $\alpha$ being a characteristic angle of orientation of the micro-mirrors.

* * * * *